United States Patent [19]

Fletcher, Jr.

[11] Patent Number: 4,733,466

[45] Date of Patent: Mar. 29, 1988

[54] BRUSH AND CUTTER UNIT FOR AN ELECTRIC RAZOR

[76] Inventor: Cortez Fletcher, Jr., 19047 Staleybridge Rd., Germantown, Md. 20874

[21] Appl. No.: 917,899

[22] Filed: Oct. 10, 1986

[51] Int. Cl.[4] ..... B26B 19/42

[52] U.S. Cl. ..... 30/34.2; 30/43.6

[58] Field of Search ..... 30/41, 34.2, 43.4–43.6, 30/346.51

[56] References Cited

U.S. PATENT DOCUMENTS 4,442,596 4/1984 Nasu et al. ..... 30/41 X

FOREIGN PATENT DOCUMENTS 201367 11/1938 Switzerland ..... 30/34.2

*Primary Examiner*—Douglas D. Watts

*Attorney, Agent, or Firm*—Burns, Doane, Swecker & Mathis

[57] ABSTRACT

A cutting unit for a rotary razor is provided which has a rotatable element for shearing hairs and a brush rotatable with the shearing element. The brush acts to position hairs for shaving and is particularly useful for alleviating pseudofolliculitis barbae and for positioning ingrown hairs for shaving.

19 Claims, 3 Drawing Figures

Fig. 1
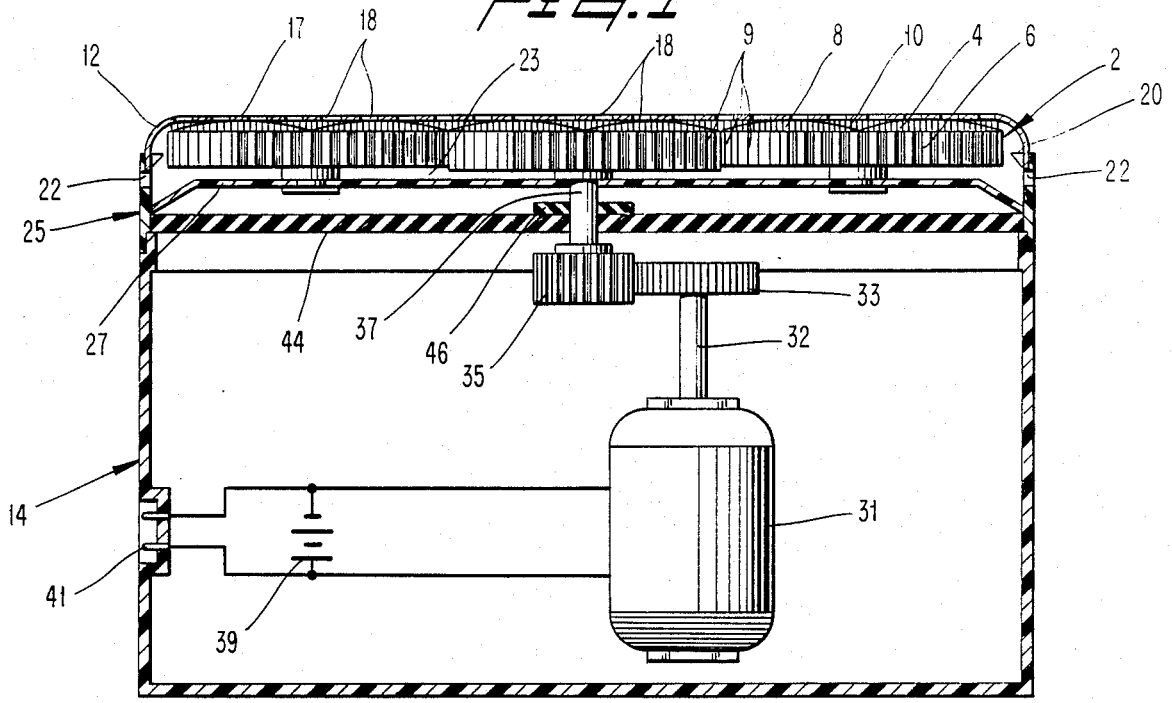
Fig. 2
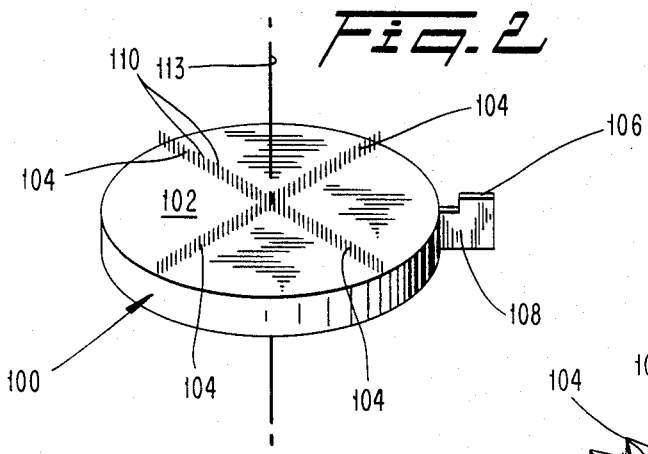
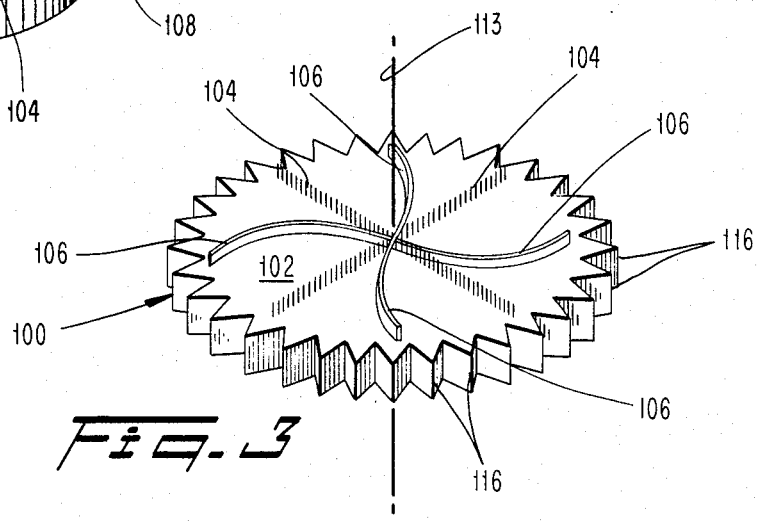
Fig. 3

BRUSH AND CUTTER UNIT FOR AN ELECTRIC RAZOR

BACKGROUND OF THE INVENTION

1. Field of the Invention

The present invention relates to a cutting element for use with electric razors. In particular, the cutting unit is rotatably driven and is provided with a brush for improved and more efficient shaving and to reduce and avoid pseudofolliculitis barbae and related conditions.

2. Description of the Prior Art

The art has previously recognized the importance of properly positioning the hairs for shaving. Ideally, the hair should be erect and standing away from the skin. In various cases, however, the hairs grow at angles acute to the skin. Moreover, such as for some black persons, the hairs tend to be extremely curled, thereby resulting in pseudofolliculitis, an imbedded hair which, when shaved, causes what is commonly referred to as razor bumps. Alternatively, when hairs are sheared so that they lie below the level of the skin, pseudofolliculitis may result from a hair which is growing partially or wholly subcutaneously.

A primary objective in obtaining a close, safe, and efficient shave is the proper positioning of the hairs to be sheared by a shearing element. Because all hairs do not normally grow perpendicular to the skin surface, a device is needed to position the hairs such that they may be effectively sheared by a shearing element.

The art has resorted to various devices in combination with electric razors to properly position hairs for shaving. U.S. Pat. No. 2,718,694 employs a fixed, stationary brush disposed between two electric shaving elements to position hairs. Similarly, U.S. Pat. No. 2,711,582 employs a fixed, curved brush to raise hairs prior to shaving. Another method for positioning the hairs is a panel-like member having grooves which engage the hairs just prior to being sheared, as shown in U.S. Pat. No. 3,940,851.

Problems with positioning the hairs are exacerbated by hairs which grow substantially parallel to the skin surface and very close thereto. Additional problems are encountered by hairs which are ingrown or embedded, such as caused by closed skin pores and various forms of pseudofolliculitis. Pseudofolliculitis is especially prevalent among black males and others who have very curly or curved facial hair. A hair emerging from a follicle will curve back onto and eventually penetrate into the skin at a point adjacent the follicle. At the point of penetration, a papule, pustule, nodule, or similar inflammatory reaction will result in the skin. To shear such hairs requires that the penetrating portion of the hair be withdrawn from the skin and that the entire hair be positioned for shearing.

These problems can be further aggravated by cutting elements which leave the sheared hair at a level below the skin surface. In such a case, pseudofolliculitis results from a hair growing into the skin adjacent the follicle but without emerging from the follicle opening at the pore. To shear such a hair requires opening the pore to provide access to the embedded hair. Then, similar to the forms of pseudofolliculitis discussed above, the hair must be positioned for shearing.

The art has also developed methods for coping with pseudofolliculitis. U.S. Pat. No. 4,325,392 discloses a facial brush for controlling pseudofolliculitis barbae comprising bristles of differing heights and stiffnesses.

In use, the bristles, preferably wet and soaped, are applied to the face prior to shaving to raise and position facial hairs.

The only prior art known to applicant relating to a hair clipper for alleviating pseudofolliculitis is U.S. Pat. No. 4,106,190. The hair clipper disclosed therein comprises a lower cutter reciprocally moved across an upper cutter to shear hair caught between cutter slots in each cutter. The moving, reciprocating cutter rubs low-lying facial hair across the direction of the hair growth to cause the hairs to become erect for cutting. This clipper, however, cannot provide a close shave because the hairs are sheared above the skin surface. Moreover, this device is directed to preventing a further occurrence of pseudofolliculitis but does not act to alleviate a present condition of such.

It is thus seen that a close shave, especially where the facial hairs are sheared to lie below the skin surface, can cause pseudofolliculitis. Even shearing the hairs above the skin surface, although tending to avoid future occurrences of the condition, does not alleviate a present condition of pseudo-folliculitis. Thus, it would be beneficial to shear facial hairs at or below the skin surface while also avoiding or alleviating pseudofolliculitis and related conditions. It would also be beneficial to medicate inflamed hair follicles containing ingrown hairs and papules, pustules, and the like resulting from the penetration of the skin by curved hairs.

OBJECTS AND BRIEF SUMMARY OF THE INVENTION

Thus, an object of the present invention is to position hairs for shaving which may be either embedded or lying very close to the skin. The achievement of the object by the present invention is advantageous in alleviating pseudofolliculitis and avoiding future occurrences of the same and similar conditions. Another object of the present invention is to gently open the hair pores to facilitate raising embedded hairs so they can be shaved. A further object of the present invention is to allow medication to be applied directly to the open pores while shaving. Still a further object of the present invention is to provide a method for agitating a shaving lubricant applied to the skin.

The present invention generally relates to an electric shaver. Shaving devices typically include a cutting unit for shearing hair and a drive mechanism associated therewith.

In accordance with the invention, the cutting unit is rotatably driven and includes a brush having bristles. The cutting unit also includes a shearing element or blade which shears the hairs. As the cutting unit is rotated, the shearing element rotates and shears hairs and the brush rotates and acts on the user's skin. As will be discussed more fully hereinafter, the rotating brush acts to lift and position hairs for shearing and also acts to gently open skin pores and position embedded hairs so that medications can be applied to the pores.

In accordance with another aspect of the invention, the shaving device is waterproof and a shaving lubricant is employed. The device also includes a guard for separating the cutting unit from the user's skin while allowing the hair stubble to engage the shearing element. The guard is attached to a portion of the device which also includes sealable ports. These ports allow a shaving lubricant and/or medicament to be injected into the area containing the cutting units and be frothed by the brush. The ports are also useful in allowing the cutting units to be easily cleaned with a stream of water.

BRIEF DESCRIPTION OF THE DRAWINGS

The foregoing and other objects, advantages, and aspects of the present invention will be ascertainable by those of ordinary skill in the art in light of th following detailed description of various embodiments of the invention when read in conjunction with the appended drawings in which:

FIG. 1 depicts a cross-sectional view of an embodiment of the shaving device of the present invention;

FIG. 2 depicts a first embodiment of the cutting unit of the present invention from a top perspective view; and FIG. 3 depicts a second embodiment of the cutting unit of the present invention from top perspective view.

DETAILED DESCRIPTION OF THE PREFERRED EMBODIMENTS OF THE INVENTION

The present invention provides a cutting unit for use in combination with a rotary electric shaver. The cutting unit has a brush integrally attached to a surface of the cutting unit which faces a user's skin. As the cutting unit rotates so does the brush, thereby raising and positioning hairs for shearing by a shearing element.

The razor and cutting unit of the present invention may be used in a wet environment. For example, a water-based shaving lubricant can be employed. Typical lubricants include soap solutions and soap/water foams (e.g., shaving creams). By the present invention, the brush integral with the cutting unit acts to agitate, spread, and foam the lubricant used. Still further, the brush acts to gently open skin pores and raise and position embedded hairs for shaving; the brush also raises and positions curved and penetrating hairs. The combined action of the brush spreading the lubricant and opening the skin pores allows the flow of the lubricant and the bristles on the brush to aid in raising and positions the hairs for shearing. An additional advantage provided by gently opening the skin pores is that medicaments in the lubricant or used in combination therewith can be applied to the skin, especially to areas inflamed by pseudofolliculitis to help to alleviate the condition.

An embodiment of the shaving device of the present invention is shown in FIG. 1. The device generally comprises a cutting unit 2 having a surface portion 4 disposed on a cutting body 6. The cutting unit further comprises a shearing element 8 fixedly attached to the body 6 and rotatable therewith. Teeth 9 may be provided integral with the body to meshingly engage similar teeth on an adjacent body. A brush 10 is fixedly attached to the surface 4 of the body so as to be rotatable therewith. The device also includes a motor and linkage for rotatably driving the cutting units. The device further includes a guard for separating the cutting units from a user's skin while allowing hair stubble to engage and be sheared by the shearing element.

The guard generally comprises an enclosing surface 12 about the cutting unit. The guard also includes a metal screen 17 disposed generally parallel to the surface portion of the cutting unit and is provided with openings 18. It is preferred that the screen be made of a very thin, flexible metal sheet which is resistant to rusting and attack by water-based lubricants and soaps. The screen 17 is attached to the enclosing surface 12 above the cutting unit 2 and, because it is flexible, may be attached and secured in a spring-like manner to the enclosing surface by abutments 20. The guard acts as a containment for the cutting unit. It is preferred that the device of the present invention comprise a plurality of cutting units which may be arranged linearly as shown in FIG. 1.

The enclosing surface of the guard comprises sealable ports 22 by which a water-based lubricant, shaving aid, and/or medication may be introduced to contact the cutting units and be contained by the closing surface. These ports include a door which can be slidingly mounted on runners or attached to the enclosing surface by hinges or similar methods. In operation, one of the ports 22 may be opened and a shaving cream may be injected to fill the volume 23 defined by the screen and the enclosing surface. The port is then closed and the razor is turned o and applied to the face. The action of the brush will agitate and froth the substance introduced through the opening and, as described before, raise and position hairs and open skin pores. If the substance introduced through the port is a lubricant or a foam, then the brush will agitate and froth the substance to provide a cleaner and more efficient shave. If the substance introduced through the port is a medicament, then as the brush gently opens the skin pores it urges the medicament into the pores. The substance introduced through the port may be a combination of a medicament and a lubricant and/or foam. When the user is done shaving, both ports are opened and water is run through the ports to clean the internal area in which the cutting units reside; the razor may be left running during the cleaning process.

A preferred substance for introducing through the ports and for use as a lubricant for shaving comprises water, SD alcohol, PEG 8, triethanolamine, benzoyl peroxide, and lauryl sulfate. Various other medicaments and lubricants can be used in addition to or instead of the above ingredients as will be readily ascertainable by those of ordinary skill in the art.

The head portion 25 comprises the cutting unit 2, the enclosing surface 12, the screen 17, and a retaining device which keeps the cutting units within the head portion and in close proximity to the screen. Such a retaining device can comprise a spring 27 as shown in FIG. 1. The retaining device is attached to the enclosing surface and contacts the cutting units on an under surface, thereby urging the cutting units towards the screen. The retaining device thus also keeps the cutting units within the volume 23 of the head portion. It is preferred that the retaining device be secured to the enclosing surface whereby the entire head portion can be separated from a drive housing 14. The drive housing contains a motor and drive linkage arrangement for rotatably driving the cutting units. For example, as shown in FIG. 1, the housing 14 encloses a motor 3I connected to a shaft 32 and a drive gear 33. The drive gear engages a second gear 35 fixedly attached to a shaft 37 which engages and rotatably drives a cutting unit 6. The cutting unit may comprise a plurality of gear teeth to meshingly engage similar gear teeth on adjacent cutting units. The motor and drive linkage arrangement may further comprise a battery 39, optionally rechargeable, for providing electrical power to the motor 31. An electrical port 41 is provided to permit an external power source to be connected to the motor and/or to recharge a battery.

As noted above, the cutting unit and shaving device of the present invention may be used in a wet environment. Therefore, for the safety of the user, the housing 14 and any electrical connections 41 should be substantially waterproofed. The shaving device shown in FIG. 1 thus also comprises a waterproofing gasket 44 between the head portion 12 and the drive housing 14 as well as a gasket 46 to prevent any liquids or foams from penetrating into the drive housing 14. Various other methods for waterproofing the motor and cutting units are known in the art.

It is preferred that those elements of which the head portion is comprised, the cutting units, the retaining device and the screen, be readily replaceable by the user. The screen portion and the retaining device may be detachable from the enclosing surface. The bodies of the cutting units may be made of plastic and thus relatively inexpensive to replace.

The cutting unit of the present invention generally comprises a circular body in the shape of a right cylinder having a surface portion, a circumference, and a base, such as in the shape of a circular disk. The cutting unit is rotatably driven and thus has an axis of rotation perpendicular to the surface portion. The circular body may be solid or may have various holes or cut-outs. Fixedly attached to the circular body is a shearing element for shearing hairs. The shearing element may be attached at any convenient and efficient point on the circular body, such as on the surface portion or around the circumference of the body.

FIG. 2 shows preferred embodiment of the cutting unit of the present invention. A circular body 100 is provided having a circular surface portion 102 and a brush 104 fixedly attached thereto. A shearing element 106 is integral with arm 108 which is fixedly attached to the circumference of the circular body. A plurality of such shearing elements and arms may be positioned around th circumference of the body. The brush is generally disposed along at least a portion of one radius of the circular surface. As shown in FIG. 2, it is preferred that the cutting unit have two brushes, each extending along at least a portion of the length of a diameter of the surface portion where the diameters are perpendicular to each other.

An alternate and preferred embodiment is shown in FIG. 3. A similar circular body 100 has a circular surface portion 102 and a brush 104 fixedly attached thereto. A helical blade functions as the shearing element 106 and is also fixedly attached to the surface portion 102.

As shown in FIGS. 2 and 3, each cutting unit has an axis of rotation 113 about which the cutting unit is driven. One method for rotatably driving the cutting unit comprises a gear which meshingly engages teeth integral with the cutting unit. As shown in FIG. 3, these teeth may be disposed about the circumference of the body, as shown by reference numeral 116. An alternate method for rotatably driving the cutting unit is a shaft 37, as is shown in FIG. 1. Moreover, multiple motors and/or multiple shafts may be used to drive a plurality of cutting units.

Although the brushes in FIGS. 2 and 3 are shown as positioned along two perpendicular diameters of the surface portion, as stated above, it is sufficient that the brush be fixedly attached to a portion of the circular surface portion and preferably be positioned on a portion of a radius of the surface portion defined as extending from the axis of rotation to the circumference of the body. Similarly, various other blade configurations will be apparent to those of ordinary skill in the art.

Each brush comprises a multiplicity of bristles 110. In general, the length of the bristles from the surface portion 102 will be equal to the extent of the shearing element 106. Further, the bristles can have differing degrees of stiffness or pliability and can also be of differing heights and have noncircular cross-sections.

The present invention is not to be limited to the embodiments shown and described above; it is to be understood that variations, changes, and modifications will be apparent and implementable by those of ordinary skill in the art. Such variations and modifications are intended to be within the scope and spirit of the present invention as defined by the following claims.

What is claimed is:

1. A device useful for shaving, comprising: at least one cutting unit having a surface portion, said unit being rotatably driveable; a shearing element fixedly attached to said cutting unit and rotatably driveable therewith; a brush fixedly attached to said surface portion and rotatably driveable with said cutting unit; means for rotatably driving said cutting unit comprising a motor means encased in a waterproof housing; guard means for separating said shearing element from a user's skin and for allowing hair stubble to engage said shearing element; means for retaining said at least one cutting unit; and a head portion detachable from said housing, said head portion comprising said guard means, said at least one cutting unit, and said retaining means.

2. A rotary shaver comprising:

a cutting unit including at least one cutting body, said cutting body having;

a support surface, a circumference, an axis of rotation extending in a direction perpendicular to said support surface, a shearing element attached to said cutting body, said shearing element including a shearing edge extending in a plane which is parallel to said support surface, and at least one brush attached to said cutting body, said brush having a plurality of bristles which extend in a direction perpendicular to said support surface; and means for rotatably driving said body about said axis of rotation.

3. A rotary shaver comprising:

a cutting unit including at least one cutting body, said cutting body having;

a support surface, a circumference, an axis of rotation extending in a direction perpendicular to said support surface, a shearing element attached to said cutting body, said shearing element including a shearing edge extending in a plane which is parallel to said support surface, and at least one brush attached to said cutting body, said brush having a plurality of bristles which extend in a direction perpendicular to said support surface;

guard means for separating said shearing element from a user's skin and for allowing hair stubble to engage said shearing element and the bristles of said brush; and means for rotatably driving said body about said axis of rotation.

4. The rotary shaver defined in claim 3, wherein said guard means includes at least one enclosing surface disposed about said at least one cutting body, said enclosing surface including a metal screen which extends in a plane parallel to said support surface.

5. The rotary shaver defined in claim 2 wherein said means for rotatably driving said cutting body comprises a gear and wherein said cutting body further comprises teeth to meshingly engage said gear.

6. The rotary shaver defined in claim 5 wherein said teeth are arranged along said circumference.

7. The rotary shaver defined in claim 2 wherein said means for rotatably driving said body comprises a shaft.

8. The rotary shaver defined in claim 2 wherein said shearing element comprises a helical blade extending along said surface.

9. The rotary shaver defined in claim 2 wherein said shearing element comprises a plurality of shearing elements disposed along said circumference.

10. The rotary shaver defined in claim 2 wherein said support surface is circular and said at least one brush extends along a diameter of the said circular support surface.

11. The rotary shaver defined in claim 10 wherein a second brush extends along another diameter of said circular surface perpendicular to said first diameter.

12. The rotary shaver defined in claim 3 wherein said shearing element is a helical blade attached to said support surface and rotatable therewith.

13. The rotary shaver defined in claim 3 wherein at least two brushes are fixedly attached to said support surface and are arranged perpendicular to each other.

14. The rotary shaver defined in claim 3 wherein said means for rotatably driving said cutting unit comprises a gear.

15. The rotary shaver defined in claim 14 wherein said cutting body further comprises teeth arranged along a circumference thereof and said gear meshingly engages said teeth.

16. The rotary shaver defined in claim 15 further comprising a plurality of cutting bodies, each having meshingly engageable teeth arranged along a circumference.

17. The rotary shaver defined in claim 4, wherein said enclosing surface further comprises sealable ports.

18. The rotary shaver defined by claim 3 wherein said means for rotatably driving said at least one cutting body comprises a motor means encased in a waterproof housing.

19. The rotary shaver defined by claim 18 further comprising a means for retaining said at least one cutting body on said cutting unit.

* * * * *